US006530786B2

(12) United States Patent
Ishikawa

(10) Patent No.: US 6,530,786 B2
(45) Date of Patent: Mar. 11, 2003

(54) PRINTED CIRCUIT BOARD-CONNECTING CONNECTOR

(75) Inventor: Tatsuya Ishikawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/742,336

(22) Filed: Dec. 22, 2000

(65) Prior Publication Data

US 2001/0018279 A1 Aug. 30, 2001

(30) Foreign Application Priority Data

Dec. 22, 1999 (JP) ..... 11-364281

(51) Int. Cl.[7] ..... H01R 12/00
(52) U.S. Cl. ..... 439/79
(58) Field of Search ..... 439/79, 59, 62, 439/649, 76.1, 87, 89, 90

(56) References Cited

U.S. PATENT DOCUMENTS 4,200,347 A * 4/1980 Sinclair et al. ..... 439/79
4,952,172 A * 8/1990 Barkus et al. ..... 439/79
5,213,515 A * 5/1993 Ishikawa et al. ..... 439/79
5,261,829 A * 11/1993 Fusselman et al. ..... 439/108
5,267,875 A * 12/1993 Koegel et al. ..... 439/607
5,346,404 A * 9/1994 Shimada ..... 439/79
5,591,036 A 1/1997 Doi et al. ..... 439/79
5,692,912 A * 12/1997 Nelson et al. ..... 439/79
6,077,092 A * 6/2000 Chiu et al. ..... 439/79
6,116,919 A * 9/2000 Tung ..... 439/79

FOREIGN PATENT DOCUMENTS

EP 0 428 359 A1 5/1991

* cited by examiner

*Primary Examiner*—Renee Luebke
*Assistant Examiner*—Briggitte Hammond
(74) *Attorney, Agent, or Firm*—Morgan, Lewis & Bockius LLP

(57) ABSTRACT

A connector includes a connector housing (10), a row of receiving chambers (CV) formed within the housing (10), and a spacer block (14) fittable to the housing (10) from an obverse surface thereof to face the row of receiving chambers (CV). The spacer block (14) is fixable at a reverse surface thereof to a printed circuit board. A plurality of connection terminals (12) are respectively insertable in the row of receiving chambers (CV). The connection terminals (12) have distal end portions (12*a*) electrically connectable to electrically-conductive circuit patterns formed on the printed circuit board. The spacer block (14) has a row of passage windows (24) which are formed in a lattice-like manner, and through which the distal end portions (12*a*) of the connection terminals (12) are respectively passable, so that the distal end portions (12*a*) of the connection terminals (12) are protected.

4 Claims, 5 Drawing Sheets

PRINTED CIRCUIT BOARD-CONNECTING CONNECTOR

BACKGROUND OF THE INVENTION

1. Field of the Invention

The present invention relates to a multi-pole connector for mounting on a surface of a printed circuit board. More particularly, the present invention relates to a spacer structure for preventing damage of distal end portions of female connection terminals to be soldered to a surf ace of the printed circuit board.

The present application is based on Japanese Patent Application No. Hei. 11-364281, which is incorporated herein by reference.

2. Description of the Related Art

A typical example of related multi-pole connectors, mounted on a surface of a printed circuit board, is shown in FIGS. 6 and 7. This connector comprises a housing 1, having two (upper and lower) rows of connection ports 1*a* formed in a front surface thereof in a longitudinal direction for respectively receiving male connection terminals (not shown), female connection terminals 2, which comprise press-shaped products of an electrically-conductive metal sheet, respectively, and are received in receiving chambers CV (not shown) disposed inwardly of the connection ports 1*a,* and a spacer block 3 fitted in an opening (not shown) formed in a rear surface of the housing 1 generally over an entire area thereof.

The spacer block 3 includes flange portions 4, which are formed respectively at opposite ends thereof, and have screw holes, respectively, a bar-like fitting portion 5, which extends between the two flange portions 4, and can be fitted in the opening in the rear surface of the housing 1, and engagement plates 7 which extend respectively from the flange portions 4, and can be engaged with lock piece portions 6 formed at opposite ends of the housing 1. Ribs 5*a* for dividing the opening, formed in the rear surface of the housing 1, into sections are formed on upper and lower surfaces of the fitting portion 5, and these ribs 5*a* cooperate with an inner peripheral surface of the opening in the rear surface of the housing 1 to form two (upper and lower) rows of narrow spaces.

Distal end portions 2*a* of the female connection terminals 2, received respectively in the inner receiving chambers, are passed respectively through these narrow spaces, and these distal end portions 2*a,* extending outwardly from the spacer block 3, are soldered respectively to predetermined portions of a surface of a printed circuit board.

In the above printed circuit board-connecting connector, when the spacer block 3 is fitted into the opening in the rear surface of the housing 1, the spacer block 3 is liable to contact the distal end portions 2*a* of the terminals to much deform the same. In addition, the exposed distal end portions 2*a* of the terminals, which are relatively long, and are bent outwardly, are liable to be deformed by an accidental external force applied during the wrapping and the transportation.

And besides, the above printed circuit board-connecting connector is fixedly secured to the surface of the printed circuit board by screws, passing respectively through the screw holes formed respectively in the flange portions 4, in such a manner that only the rear surfaces of the opposite end portions of the connector are held against the surface of the printed circuit board. Therefore, the whole of the printed circuit board-connecting connector can not be firmly fixed to the surface of the printed circuit board.

SUMMARY OF THE INVENTION

The present invention has been made in order to solve the above problems, and an object of the present invention is to provide a printed circuit board-connecting connector which protects connection terminals, and can be mounted on a printed circuit board in a more stable condition.

To achieve the above object, according to the first aspect of the present invention, there is provided a connector which comprises a housing, a row of receiving chambers formed within the housing, a spacer block fittable to the housing from an obverse surface thereof to face the row of receiving chambers, the spacer block being fixable at a reverse surface thereof to a printed circuit board, and a plurality of connection terminals respectively insertable in the row of receiving chambers, the connection terminals having distal end portions electrically connectable to electrically-conductive circuit patterns formed on the printed circuit board, wherein the spacer block has a row of passage windows which are formed in a lattice-like manner, and through which the distal end portions of the connection terminals are respectively passable, so that the distal end portions of the connection terminals are protected.

In this connector, when the spacer block is fitted to the housing, that is, when attaching the spacer block to the housing, the distal end portions of the connection terminals are received and held in the passage windows, respectively. Therefore, the deformation of the distal end portions of the terminals is prevented during the insertion (and attachment) of the spacer block. Even after the connector is assembled, the distal end portions of the terminals are protected by the passage windows, respectively, and therefore the distal end portions of the terminals are prevented from being deformed by an external force.

Further, according to the second aspect of the present invention, it is preferable that the reverse surface of the spacer block to be held in contact with the printed circuit board is substantially flat generally over an entire area thereof. In this construction, the reverse surface of the spacer block is flat over the entire area thereof, and therefore the area of contact between the spacer block and the printed circuit board is increased. Therefore, the whole of the printed circuit board-connecting connector can be firmly fixed to the surface of the printed circuit board, and besides the flexural rigidity of the spacer block can be increased.

Further, according to the third aspect of the present invention, it is preferable that the spacer block has at least one positioning projection formed on the reverse surface thereof to be opposed to the printed circuit board, and the at least one positioning projection is insertable into a hole formed in the printed circuit board. In this construction, the spacer block has the at least one positioning projection formed on the reverse surface thereof to be opposed to the printed circuit board, and therefore the connector can be easily and accurately positioned relative to the printed circuit board by inserting the positioning projection into the hole formed in the printed circuit board.

DETAILED DESCRIPTION OF THE PREFERRED EMBODIMENT

Figure 1:
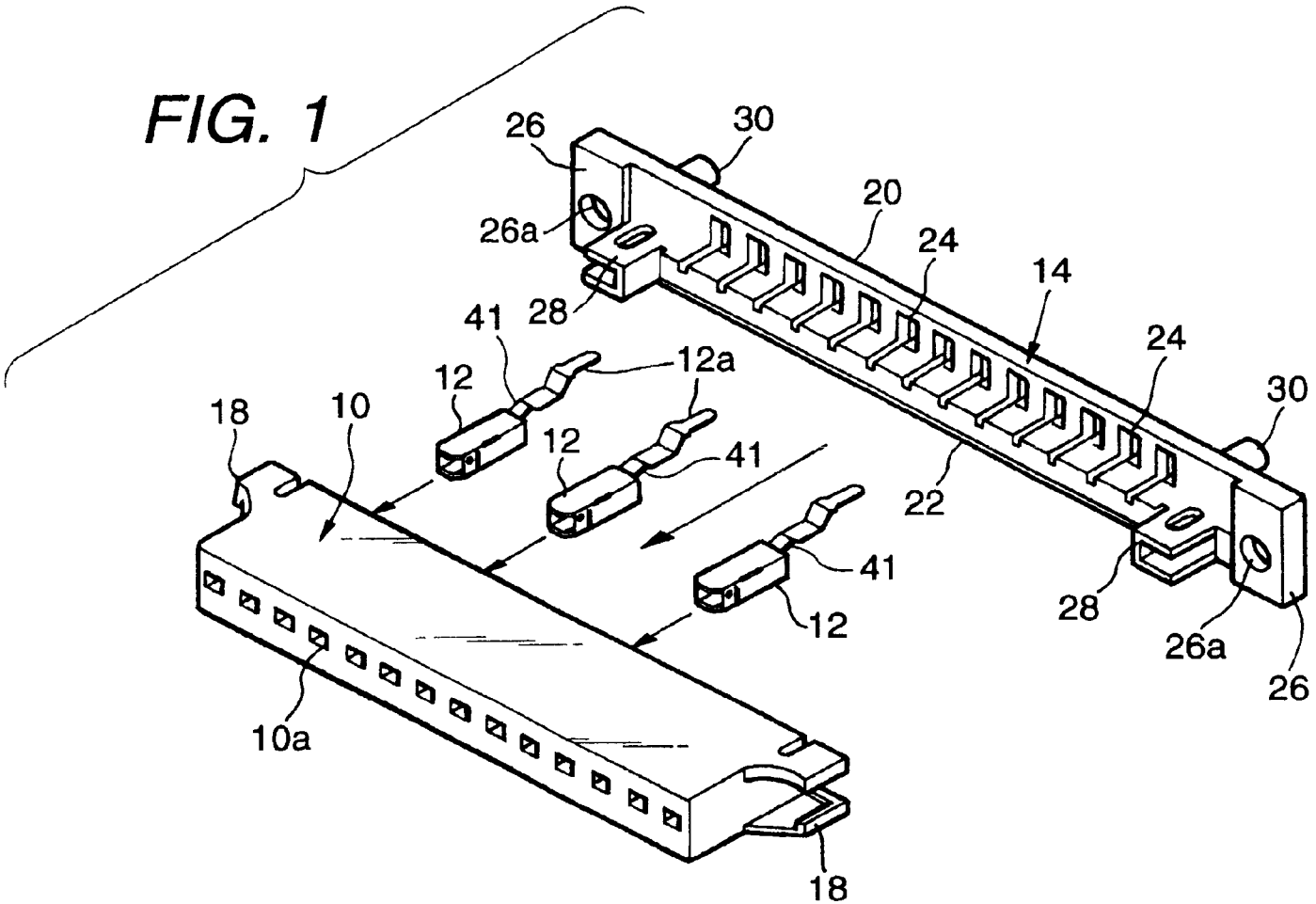
FIG. 1 is an exploded, perspective view of a printed circuit board-connecting connector of the present invention, showing important portions thereof.
Figure 3:
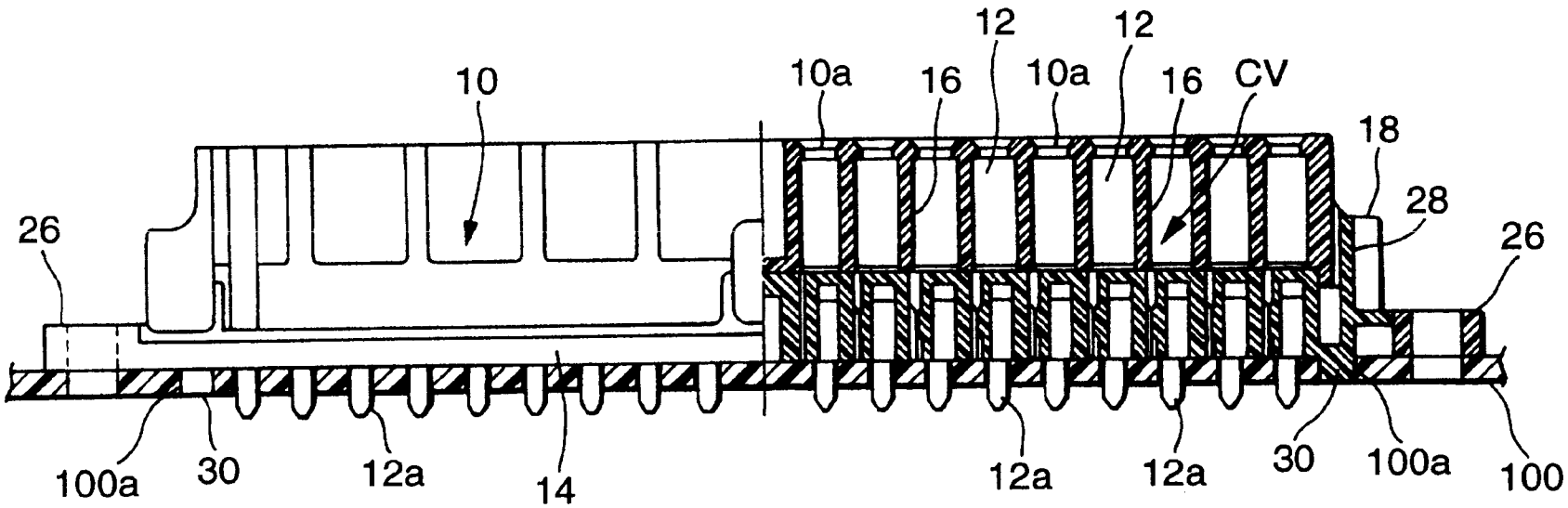
FIG. 3 is a partly-broken side-elevational view of the printed circuit board-connecting connector of the present invention shown in FIG. 2.
Figure 4:
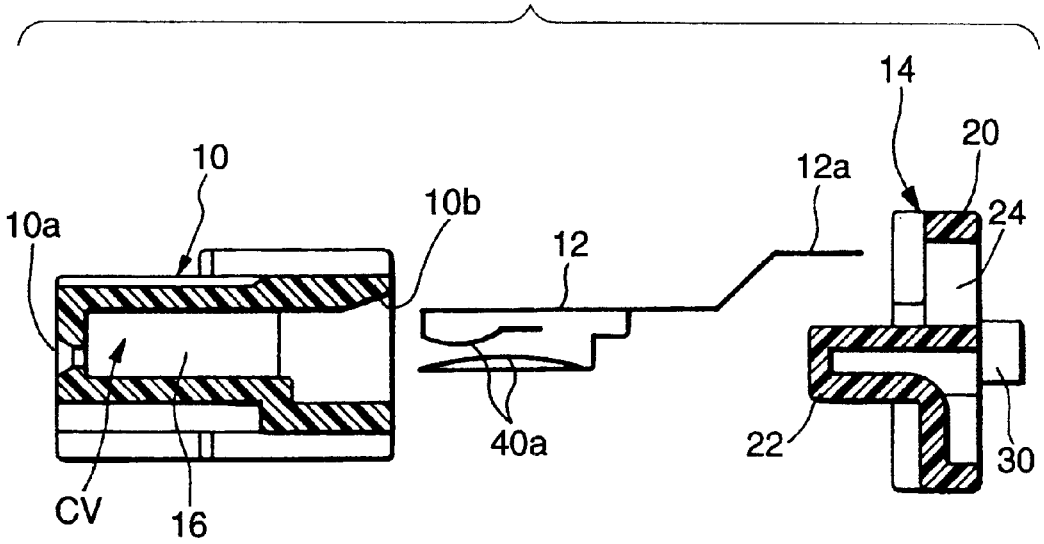
FIG. 4 is an exploded, transverse cross-sectional view of the printed circuit board-connecting connector of the present invention, showing the important portions thereof.
Figure 5:
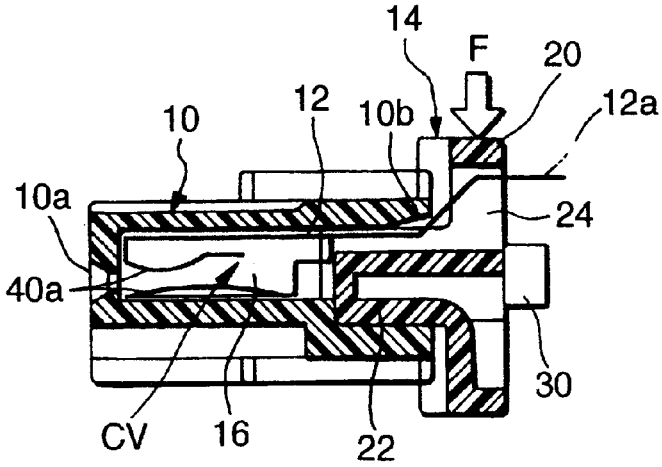
FIG. 5 is a transverse cross-sectional view of the important portions of FIG. 4 in an assembled condition.
Figure 6:
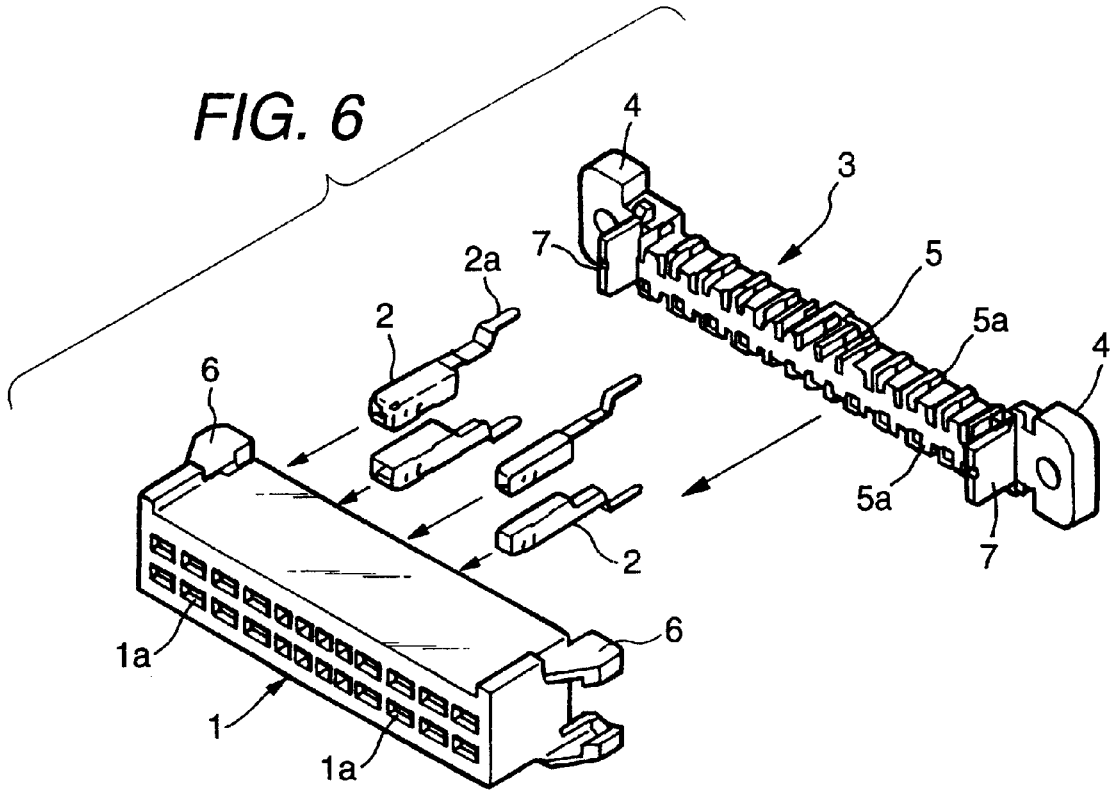
FIG. 6 is an exploded, perspective view of a related printed circuit board-connecting connector, showing important portions thereof.
Figure 7:
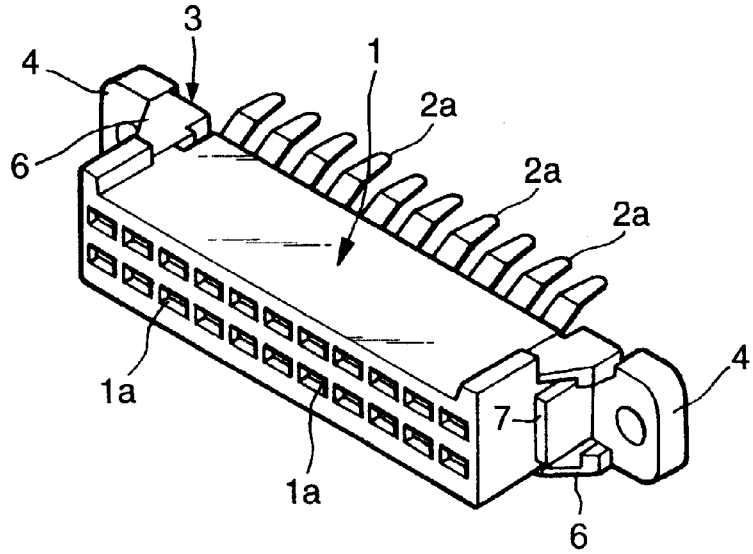
FIG. 7 is a perspective view of the important portions of FIG. 6 in an assembled condition.

One preferred embodiment of a printed circuit board-connecting connector of the present invention will now be described in detail with reference to the accompanying drawings. FIG. 1 is an exploded, perspective view of the printed circuit board-connecting connector of the present invention, showing important portions thereof, FIG. 2 is a perspective view of the important portions of FIG. 1 in an assembled condition, FIG. 3 is a partly-broken side-elevational view of the printed circuit board-connecting connector of the present invention shown in FIG. 2, FIG. 4 is an exploded, transverse cross-sectional view of the printed circuit board-connecting connector of the present invention, showing the important portions thereof, and FIG. 5 is a transverse cross-sectional view of the important portions of FIG. 4 in an assembled condition.

Figure 2:
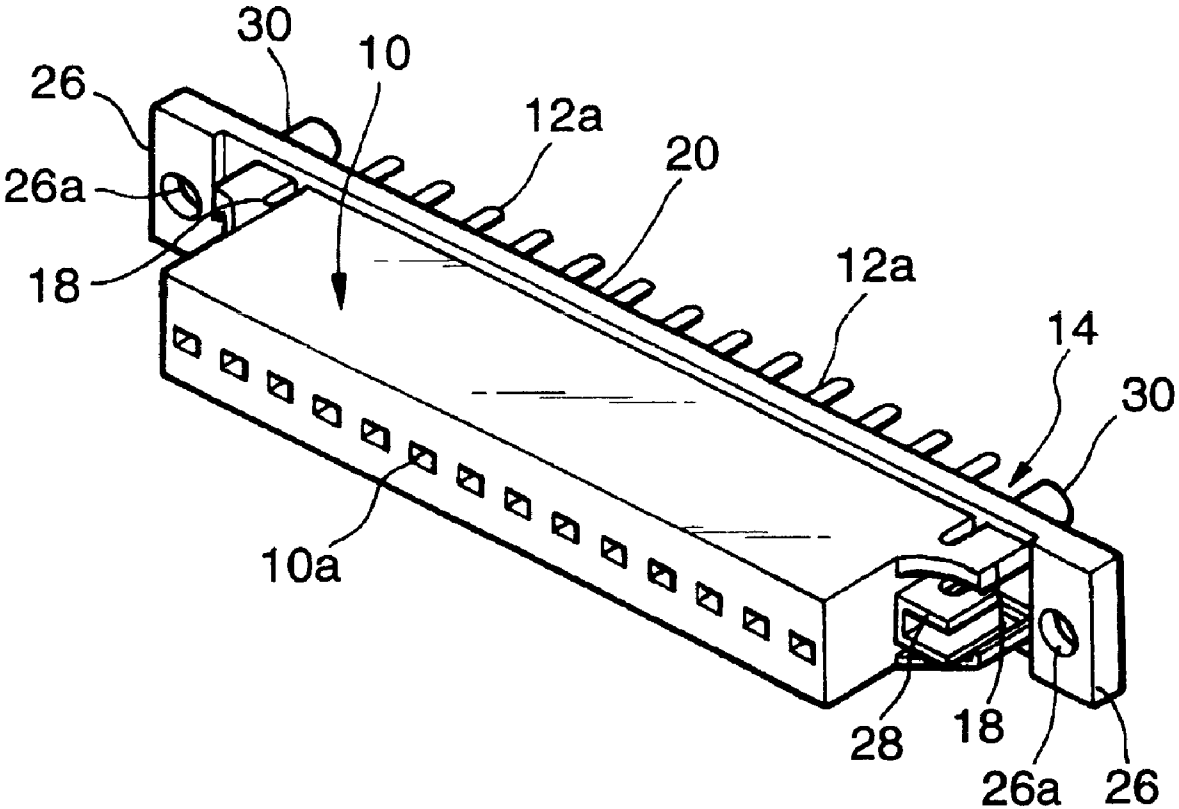
FIG. 2 is a perspective view of the important portions of FIG. 1 in an assembled condition.

As shown in FIGS. 1 and 2, the printed circuit board-connecting connector of the present invention comprises a housing 10, made of a resin material or the like, female connection terminals 12, each comprising a press-shaped product of an electrically-conductive metal sheet, and a spacer block 14 of a resin material or the like fitted in the housing 10.

More specifically, the housing 10 includes an elongate, rectangular shape, and a plurality of connection ports 10*a* are formed in that surface of the rectangular housing 10 facing away from the spacer block 14. A plurality of partition walls 16 are formed within a space which is formed in the housing, and is disposed inwardly of the connection ports 10*a,* and this space is divided into separate receiving chambers CV by the partition walls 16 (see FIG. 3). A fitting opening 10*b* is formed in a rear surface of the housing 10 generally over an entire area thereof (see FIG. 4). Lock piece portions 18 for retaining the spacer block 14 are formed at opposite ends of the housing 10.

The female connection terminal 12 includes a hollow, rectangular contact portion 40 for being received in the receiving chamber CV. A contact point portion 40*a* is provided within the contact portion 40. The female connection terminal 12 of an integral construction is formed by pressing, and a distal end portion 12*a* of this terminal is connected to the contact portion 40 through a piece portion 41.

The spacer block 14 includes a base bottom portion 20 in the form of a flat plate, which is larger in width than the housing 10, and a fitting block portion 22 which is formed on an upper surface of the base bottom portion 20, and can be fitted into the fitting opening 10*b* in the housing 10. A row of rectangular passage windows 24, formed in a lattice-like manner, for respectively passing the distal end portions 12*a* of the female connection terminals 12 therethrough are formed through the base bottom portion 20. Engagement plates 28 for engagement with the respective lock piece portions 18 on the housing 10 are formed on and project from opposite ends of the fitting block portion 22. Flange portions 26 are formed respectively at opposite ends of the base bottom portion 20, and are disposed outwardly of the corresponding engagement plates 28. Screw holes 26*a* are formed through the flange portions 26, respectively, and the flange portions 26 are fixedly secured to a printed circuit board 100 by screws passing respectively through the screw holes 26*a*.

Positioning projections 30 are formed on the reverse surface of the spacer block 14 to be opposed to the printed circuit board. As shown in FIG. 3, the positioning projections 30 are inserted respectively into holes 100*a,* formed through the printed circuit board 100, thus fixing the spacer block 14, and by doing so, the printed circuit board-connecting connector can be easily and accurately positioned relative to the printed circuit board.

Next, a method of assembling this printed circuit board-connecting connector will be described. In the printed circuit board-connecting connector, the contact portions 40 of the female connection terminals 12 are inserted respectively into the receiving chambers CV in the housing 10 while the distal end portions 12*a* of the female connection terminals 12 are passed respectively through the passage windows 24 in the spacer block 14. As a result, the housing 10, the female connection terminals 12 and the spacer block 14 are fixed relative to one another, so that the connector is assembled as shown in FIG. 5.

As shown in FIG. 5, a great part (length) of the distal end portion 12*a* of each female connection terminal 12 is received in the corresponding passage window 24, and therefore during the assemblage of the connector, the distal end portions 12*a* of the female connection terminals 12 are prevented from deformation. Even when for example, an external force F (see FIG. 5) is applied to the connector after the assemblage of the connector, damage (such as deformation) of the distal end portions 12*a* of the terminals is prevented.

And besides, the lower surface of the spacer block 14, held in contact with the printed circuit board 100, is flat over the entire area thereof, and therefore the area of contact between the spacer block 14 and the printed circuit board 100 is increased. Therefore, the flexural rigidity of the connector, fixed to the printed circuit board, is increased, and the whole of the connector can be firmly fixed to the printed circuit board in a stable condition. And besides, the strength of the spacer block 14 can be increased.

Therefore, in the present invention, there can be provided the printed circuit board-connecting connector which overcomes the problems of the related construction, and protects the connection terminals, and can be mounted on the printed circuit board in a more stable condition.

In the printed circuit board-connecting connector of the present invention, when inserting the spacer block into the housing, that is, when attaching the spacer block to the housing, the distal end portions of the connection terminals are received and held in the passage windows, respectively. Therefore, the deformation of the distal end portions of the terminals is prevented during the insertion (and attachment) of the spacer block. Even after the connector is assembled, the distal end portions of the terminals are protected by the passage windows, respectively, and therefore the distal end portions of the terminals are prevented from being deformed by an external force.

In the printed circuit board-connecting connector of. the present invention, the reverse surface of the spacer block is flat over the entire area thereof, and therefore the area of contact between the spacer block and the printed circuit board is increased. Therefore, the whole of the printed circuit board-connecting connector can be firmly fixed to the surface of the printed circuit board, and besides the flexural rigidity of the spacer block can be increased.

In the printed circuit board-connecting connector of the present invention, the spacer block has the positioning projections formed on the reverse surface thereof to be opposed to the printed circuit board, and therefore the connector can be easily and accurately positioned relative to the printed circuit board by inserting the positioning projections respectively into the holes formed in the printed circuit board.

What is claimed is:

1. A connector, comprising:

a housing;

a row of receiving chambers formed within the housing;

a spacer block fittable to the housing from an obverse surface thereof fitting into the row of receiving chambers, the spacer block being fixable at a reverse surface thereof to a printed circuit board; and a plurality of connection terminals respectively insertable in the row of receiving chambers, the connection terminals having distal end portions electrically connectable to electrically-conductive circuit patterns formed on the printed circuit board, wherein the spacer block has a row of passage windows which are arranged so as to define a lattice and which face the row of receiving chambers, and through which the distal end portions of the connection terminals are respectively passable, so that the distal end portions of the connection terminals are protected.

2. The connector of claim 1, wherein the reverse surface of the spacer block to be held in contact with the printed circuit board is substantially flat generally over an entire area thereof.

3. The connector of claim 1, wherein the spacer block has at least one positioning projection formed on the reverse surface thereof to be opposed to the printed circuit board, and the at least one positioning projection is insertable into a hole formed in the printed circuit board.

4. The connector of claim 2, wherein the spacer block has at least one positioning projection formed on the reverse surface thereof to be opposed to the printed circuit board, and the at least one positioning projection is insertable into a hole formed in the printed circuit board.

* * * * *